US006269894B1

(12) United States Patent
Griffin

(10) Patent No.: US 6,269,894 B1
(45) Date of Patent: Aug. 7, 2001

(54) CUTTING ELEMENTS FOR ROTARY DRILL BITS

(75) Inventor: Nigel Dennis Griffin, Whitminster (GB)

(73) Assignee: Camco International (UK) Limited, Stonehouse (GB)

( * ) Notice: Subject to any disclaimer, the term of this patent is extended or adjusted under 35 U.S.C. 154(b) by 0 days.

(21) Appl. No.: 09/379,865

(22) Filed: Aug. 24, 1999

(51) Int. Cl.[7] ..... E21B 10/46
(52) U.S. Cl. ..... 175/434
(58) Field of Search ..... 175/434, 432

(56) References Cited

U.S. PATENT DOCUMENTS

| | | | | |
|---|---|---|---|---|
| 3,938,599 | * | 2/1976 | Horn | 175/434 |
| 4,604,106 | | 8/1986 | Hall et al. . | |
| 4,629,373 | | 12/1986 | Hall . | |
| 4,766,040 | * | 8/1988 | Hillert et al. | 428/552 |
| 4,871,377 | * | 10/1989 | Frushour | 51/309 |
| 5,337,844 | * | 8/1994 | Tibbitts | 175/434 |
| 5,469,927 | * | 11/1995 | Griffin | 175/432 |
| 5,645,617 | | 7/1997 | Frushour . | |
| 5,924,501 | * | 7/1999 | Tibbitts | 175/429 |
| 6,068,913 | * | 5/2000 | Cho et al. | 428/212 |

FOREIGN PATENT DOCUMENTS

| | | |
|---|---|---|
| 0 297 071 | 12/1988 | (EP) . |
| 0 329 955 | 8/1989 | (EP) . |
| 0 474 092 | 3/1992 | (EP) . |
| 0 601 840 | 6/1994 | (EP) . |
| 2 323 110 | 9/1998 | (GB) . |
| 2 324 553 | 10/1998 | (GB) . |
| 97/30264 | 8/1997 | (WO) . |

* cited by examiner

*Primary Examiner*—Hoang Dang
(74) *Attorney, Agent, or Firm*—Jeffery E. Daly

(57) ABSTRACT

A cutting element for a rotary drag-type drill bit comprises a body of polycrystalline diamond incorporating a binder-catalyst selected from iron group elements, such as iron, cobalt and nickel, or alloys thereof. The body of polycrystalline diamond is unsupported by an integral substrate. The cutting element may be mounted directly on the body of the drill bit, or may be brazed to a substrate of a different, less hard material which is in turn mounted on the drill bit.

13 Claims, 1 Drawing Sheet

Fig. 1
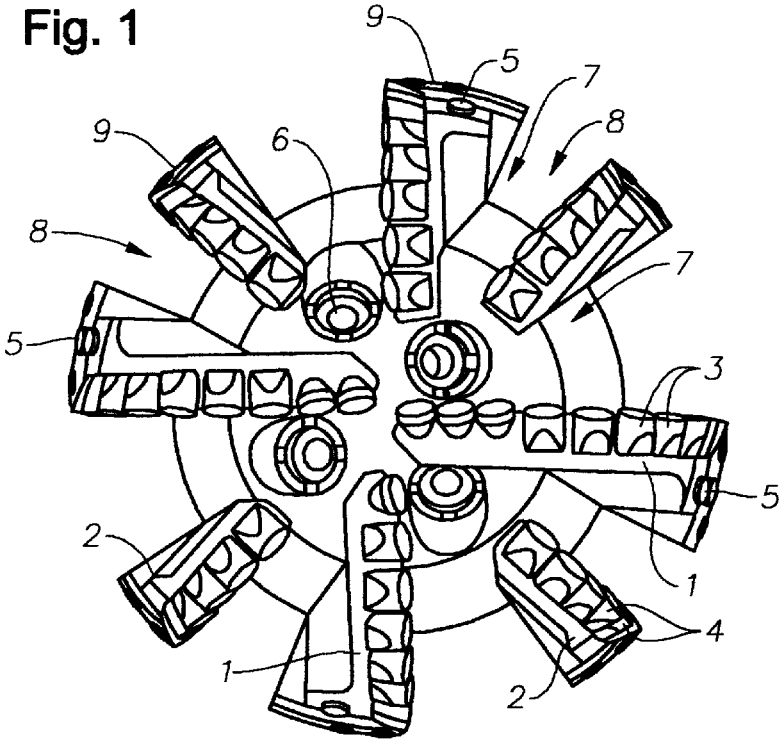
Fig. 5
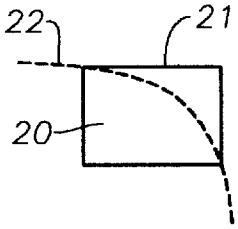
Fig. 7
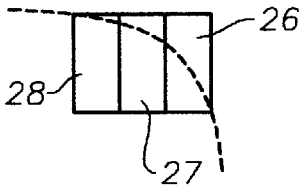
Fig. 8
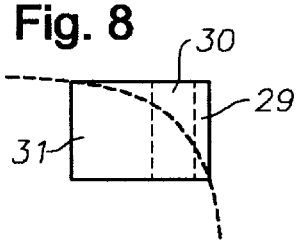
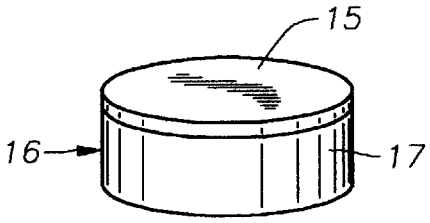
Fig. 2
(Prior Art)
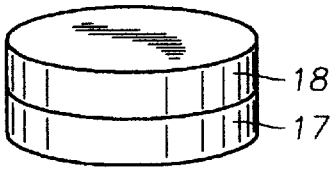
Fig. 3
(Prior Art)
Fig. 9
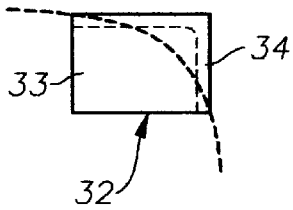
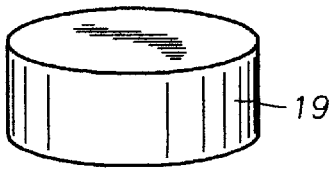
Fig. 4
Fig. 10
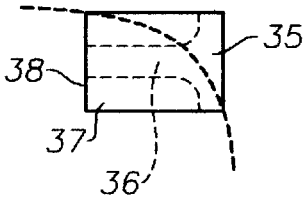
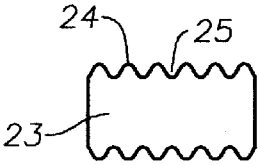
Fig. 6

CUTTING ELEMENTS FOR ROTARY DRILL BITS

BACKGROUND OF THE INVENTION

1. Field of the Invention

The invention relates to cutting elements for rotary drill bits and particularly to cutting elements for drag-type drill bits comprising a bit body having a leading surface to which the cutting elements are fixedly mounted.

2. Description of the Prior Art

As is well known, one common form of cutting element for a rotary drag-type drill bit is a two-layer or multi-layer cutting element where a facing table of polycrystalline diamond is integrally bonded to a substrate of less hard material, such as tungsten carbide. The cutting element is usually in the form of a tablet, usually circular or part-circular. The substrate of the cutting element may be brazed to a carrier, usually also of cemented tungsten carbide, which is received in a socket in the bit body, or the substrate itself may be of sufficient axial length to be mounted directly in a socket in the bit body.

As is well known, polycrystalline diamond is formed by compressing diamond powder with a suitable binder-catalyst in a high pressure, high temperature press. In one common process for manufacturing two-layer cutting elements, diamond powder is applied to the surface of a preformed tungsten carbide substrate incorporating cobalt. The assembly is then subjected to very high temperature and pressure in a press. During this process cobalt migrates from the substrate into the diamond layer and acts as a binder-catalyst causing the diamond particles to bond to one another with diamond-to-diamond bonding, and also causing the diamond layer to bond to the substrate.

Although cobalt is commonly used as the binder-catalyst, any iron group element, such as cobalt, nickel or iron, or alloys thereof, may be employed. Polycrystalline diamond using iron group elements, or alloys thereof, as a binder-catalyst will be referred to herein as "conventional" polycrystalline diamond. Other forms of polycrystalline diamond are sometimes used as cutters in rotary drag-type drill bits, for example silicon may be used as the binder-catalyst or a conventional binder catalyst such as cobalt may be leached out of the diamond after formation. Such forms of polycrystalline diamond are not usually formed on a substrate and are generally more thermally stable than conventional polycrystalline diamond. However, problems may arise in the use of such materials as cutting elements.

When two-layer cutting elements using conventional polycrystalline diamond were first manufactured the polycrystalline diamond facing table was very thin in relation to the thickness of the substrate. More recently, however, the thickness of the diamond facing table has often been increased relative to the thickness of the substrate, particularly around the periphery of the cutting element. Such arrangements are shown, for example, in WO 97/30264. Also GB 2323110 suggests extending part of the diamond facing table through the thickness of the substrate, and up to the rear surface thereof, so that part of the diamond facing table engages the surface on which the cutting element is mounted so as to provide high modulus support (the modulus of elasticity of the diamond being greater than that of the substrate itself).

According to the present invention, the advantages provided by such arrangements are enhanced by use of cutting elements which consist entirely of conventional polycrystalline diamond material and do not incorporate an integral substrate.

SUMMARY OF THE INVENTION

According to the invention, there is provided a cutting element for a rotary drag-type drill bit comprising a body of polycrystalline diamond incorporating a binder-catalyst selected from iron group elements or alloys thereof, said body of diamond being unsupported by an integral substrate.

The term "iron group elements", as used herein, includes iron and those other elements, such as cobalt and nickel, which are in the same group as iron in the Periodic Table of the elements.

The invention also provides a cutting element for a rotary drag-type drill bit comprising a body of polycrystalline diamond incorporating a binder-catalyst selected from iron group elements or alloys thereof, said body being brazed to a substrate by use of a brazing alloy.

In this case, the substrate may comprise a body of diamond/tungsten carbide/binder-catalyst composite material, or a body of cemented tungsten carbide, or two bodies of said materials respectively, brazed together by use of a brazing alloy.

The invention also provides a cutting element for a rotary drag-type drill bit comprising a body of polycrystalline diamond incorporating a binder-catalyst selected from iron group elements or alloys thereof which has been integrally bonded, in a high pressure, high temperature press, to a body of diamond/tungsten carbide/binder-catalyst composite material. Preferably a portion of the body of polycrystalline diamond which is nearer to the body of composite material includes a greater proportion of binder-catalyst than a portion thereof which is further from the composite material.

In any of the cutting elements according to the invention, the cutting element may have an outer surface which is coated with a material to allow the cutting element to be brazed to another material. Alternatively or additionally, the outer surface of the cutting element may be formed with a plurality of projections and recesses, which in use, interlock with a material within which the cutting element is embedded.

In any of the above arrangements the cutting element may be in the form of a tablet having generally parallel front and rear surfaces and a peripheral surface which may be circular, part circular, or of any other suitable shape.

The invention also provides a method of manufacturing a cutting element for a rotary drill bit, comprising the steps of forming a preform element by bonding a body of diamond particles to a surface of a substrate incorporating tungsten carbide and a binder-catalyst selected from iron group elements or alloys thereof, in a high pressure, high temperature press, so that binder-catalyst from the substrate migrates into the diamond layer, then subsequently removing the preform element from the press and removing the substrate so as to leave only a body of polycrystalline diamond incorporating the binder-catalyst, unsupported by a substrate.

The invention also provides a method of manufacturing a cutting element for a rotary drill bit comprising the steps of manufacturing a preform element by forming a mixture of diamond particles and particles of a binder-catalyst selected from iron group elements or alloys thereof and subjecting the mixture to high pressure and temperature in a press, sufficient to bond the particles together with diamond-to-diamond bonding.

In this method a layer consisting of diamond particles alone may be applied to the mixture of diamond and binder-catalyst particles before it is subjected to high pressure and temperature in the press, so that, during pressing, some binder-catalyst from the mixture migrates into the diamond layer.

The invention also provides a method of manufacturing a cutting element for a rotary drill bit comprising forming a mixture of diamond particles, tungsten carbide particles and particles of a binder-catalyst selected from iron group elements or alloys thereof, applying to the mixture of particles a layer of particles consisting of diamond alone, and subjecting the mixture and layer to high pressure and temperature in a press so that the particles bond to one another and some binder-catalyst from the diamond/tungsten carbide/binder-catalyst mixture migrates into the layer of diamond particles.

In a modification of this method, there is disposed between the diamond layer and the diamond/tungsten carbide/binder-catalyst mixture an intermediate layer comprising a mixture of diamond and binder-catalyst particles so that it is binder-catalyst from the intermediate layer which migrates into the layer of diamond particles alone.

BRIEF DESCRIPTION OF THE DRAWINGS

The following is a more detailed description of embodiments of the invention, by way of example, reference being made to the accompanying drawings in which:

FIG. 1 is a diagrammatic end view of the leading face of a typical drag-type drill bit of the general kind to which the present invention is applicable;

FIGS. 2 and 3 are diagrammatic perspective views of typical prior art polycrystalline diamond cutting elements;

FIG. 4 is a diagrammatic perspective view of a preform element for use in the present invention; and FIGS. 5–10 are diagrammatic longitudinal sectional views through preform cutting elements for rotary drag-type drill bits in accordance with the present invention.

DETAILED DESCRIPTION OF THE PREFERRED EMBODIMENTS

Referring to FIG. 1, the drill bit comprises a bit body on which are formed four primary blades 1 and four secondary blades 2. The blades extend generally radially with respect to the bit axis.

The leading edges of the secondary blades are substantially equally spaced with respect to one another, but the leading edge of each secondary blade is closer to its associated preceding primary blade than it is to the following primary blade.

Primary cutters 3 are spaced apart side-by-side along each primary blade 1 and secondary cutters 4 are spaced apart side-by-side along each secondary blade 2. Each secondary cutter 4 is located at the same radial distance from the bit axis as an associated one of the primary cutters on the preceding primary blade.

Each cutter 3, 4 is generally cylindrical and of circular cross-section and comprises a front facing table of polycrystalline diamond bonded to a cylindrical substrate of cemented tungsten carbide. Each cutter is received within a part-cylindrical pocket in its respective blade.

The primary cutters 3 are arranged in a generally spiral configuration over the drill bit so as to form a cutting profile which sweeps across the whole of the bottom of the borehole being drilled. The three outermost cutters 3 on each primary blade 1 are provided with back-up studs 5 mounted on the same primary blade rearwardly of the primary cutters. The back-up studs may be in the form of cylindrical studs of tungsten carbide embedded with particles of synthetic or natural diamond.

The bit body is formed with a central passage (not shown) which communicates through subsidiary passages with nozzles 6 mounted at the surface of the bit body. Drilling fluid under pressure is delivered to the nozzles 6 through the internal passages and flows outwardly through the spaces 7 between adjacent blades for cooling and cleaning the cutters. The spaces 7 lead to junk slots 8 through which the drilling fluid flows upwardly through the annulus between the drill string and the surrounding formation. The junk slots 8 are separated by gauge pads 9 which bear against the side wall of the borehole and are formed with bearing or abrasion inserts (not shown). This is just one example of a rotary drag-type drill bit, and many other designs are in use and will be know to those skilled in the art.

The bit body and blades may be machined from metal, usually steel, which may be hardfaced. Alternatively the bit body, or a part thereof, may be moulded from matrix material using a powder metallurgy process. The methods of manufacturing drill bits of this general type are well known in the art and will not be described in detail.

FIG. 2 shows a typical prior art cutting element in which conventional polycrystalline diamond is normally used. The polycrystalline diamond comprises the facing table 15 of a two-layer circular cylindrical cutting element 16 of generally tablet-like form. The diamond facing table 15 is integrally bonded to a significantly thicker substrate 17 of cemented tungsten carbide.

As previously mentioned, such preform cutting elements are manufactured by applying to the surface of the substrate 17 a layer of diamond powder, the substrate and diamond layer then being subjected to extremely high pressure and temperature in a press. During the formation process, cobalt from the substrate 17 migrates into the diamond layer and acts as a catalyst, resulting in the diamond particles bonding together and to the substrate.

Preform cutting elements may also be manufactured where the diamond layer is substantially thicker, as shown for example in FIG. 3.

In order to achieve cutting elements which consist entirely of polycrystalline diamond in accordance with the invention, the substrate 17 may be totally removed from the preform element, e.g. by grinding, EDM or other machining process, to leave just a tablet consisting solely of polycrystalline diamond, as indicated at 19 in FIG. 4.

A preform element consisting of 100% polycrystalline diamond may also be formed by pressing a mixture of diamond and cobalt powder in the high pressure, high temperature press. In this case a substrate is not required since the cobalt powder incorporated in the mixture itself effects the bonding of the diamond particles together. The mixture might also include other powdered materials, such as powdered tungsten carbide, so that the preform element from which the abrasive particles are formed is a composite material.

The present invention provides for the use of elements consisting entirely of conventional polycrystalline diamond material, e.g. as described in relation to FIG. 4, as preform cutting elements for drag-type rotary drill bits. Such elements may be formed by removing the substrate from two-layer polycrystalline diamond elements, or by moulding the elements in a high pressure, high temperature press from a mixture of powdered diamond and binder-catalyst, or a mixture or powdered diamond, tungsten carbide and binder-catalyst.

FIGS. 5–10 show cutting elements of this kind.

In the following arrangements and methods, the binder-catalyst is, for convenience, described as consisting of cobalt, since this is the material most commonly used for this purpose in the manufacture of conventional polycrystalline diamond on a substrate. However, in accordance with the present invention, the binder-catalyst in any of the following arrangements and methods may comprise any iron group element, such as iron, cobalt or nickel, or alloys thereof.

FIG. 5 shows a circular cylindrical cutting element 20 which is formed entirely from polycrystalline diamond incorporating cobalt by any of the methods referred to above. In this case the axial length of the element is greater than its diameter and the element is secured in a bit body, indicated diagrammatically at 22.

The cutting element 20 may be secured in the bit body 22 by shrink fitting or it may be brazed in the bit body 22. Since polycrystalline diamond cannot normally be wetted by brazing alloy, the element is preferably formed with a metallic coating prior to the brazing operation. For example, the surface of the cutting element may be treated by any known process which creates carbides on the surface of the element so as to permit brazing.

In the arrangement of FIG. 6, the polycrystalline diamond cutting element 23 is formed with peripheral ribs 24 and grooves 25 so that the cutter may be mechanically locked into the bit body. For example, the cutting element may be moulded into the bit body during its manufacture from solid infiltrated matrix by the above-described powder metallurgy process, a low temperature infiltrant alloy being used to prevent degradation of the diamond. Alternatively, the cutting element 23 could be brazed into a socket in a bit body, the provision of the ribs 24 and grooves 25 then increasing the braze area as well as providing some mechanical interlocking.

In the arrangement of FIG. 7 the polycrystalline diamond cutting element 26 is brazed to a co-extensive tablet 27 of a diamond composite material which is in turn brazed to a co-extensive tablet 28 of cemented tungsten carbide. The diamond composite tablet 27 is formed by pressing a mixture of diamond, tungsten carbide and cobalt particles in a high pressure, high temperature press.

In the arrangement of FIG. 8, the polycrystalline diamond is incorporated in a cutting element comprising three integral layers: a front layer 29 of normal polycrystalline diamond, an intermediate layer 30 of polycrystalline diamond with a higher cobalt content and a rear layer 31 comprising diamond, tungsten carbide and cobalt.

The element of FIG. 8 is manufactured by pressing, in a high pressure, high temperature press, a composite of particulate materials in three layers. The first layer, corresponding to layer 29, comprising diamond particles alone, a second layer comprising an admixture of diamond particles and cobalt powder, and a third, deeper layer comprising a mixture of diamond particles, tungsten carbide particles, and cobalt powder. During the pressing operation cobalt from the second, intermediate layer migrates into the first diamond layer so as to create the layer 29 of bonded diamond particles. The layer 29, having received only cobalt which has migrated from the second layer, will contain less cobalt than the second layer 30. The lower proportion of cobalt in the first layer improves its abrasion resistance. This is desirable since the first layer provides the cutting face of the element.

In the arrangement of FIG. 9 the cutting element 32 comprises a body 33 of diamond composite having along its front and outer surfaces a layer 34 of polycrystalline diamond. In this case, the element is manufactured by forming a body of diamond composite particles, comprising diamond, tungsten carbide and cobalt, and then applying thereto a layer of diamond particles alone to form the layer 34. In the press cobalt from the diamond composite body 33 migrates into the diamond layer 34 to form the layer of conventional polycrystalline diamond.

FIG. 10 shows another form of cutting element manufactured by this method, but in this case the polycrystalline diamond provides the front layer 35 of the cutting element and a column 36 of polycrystalline diamond which extends through the surrounding diamond composite 37 to the rear face 38 of the cutting element. The column 36 of polycrystalline diamond thus provides a high modulus support for the front cutting table 35 of the element, transmitting loads applied to the front cutting table directly to the bit body.

Whereas the present invention has been described in particular relation to the drawings attached hereto, it should be understood that other and further modifications, apart from those shown or suggested herein, may be made within the scope and spirit of the present invention.

What is claimed:

1. A cutting element for a rotary drag-type drill bit comprising a body of polycrystalline diamond incorporating a binder-catalyst selected from iron group elements or alloys thereof, said body being brazed to a substrate by use of a brazing alloy wherein the substrate comprises a body of diamond/tungsten carbide/binder-catalyst composite material.

2. A cutting element according to claim 1, wherein the substrate comprises a body of cemented tungsten carbide.

3. A cutting element according to claim 1, wherein the cutting element has an outer surface which is coated with a material to allow the cutting element to be brazed to another material.

4. A cutting element according to claim 1, wherein the cutting element has an outer surface which is formed with a plurality of projections and recesses which, in use, interlock with a material within which the cutting element is embedded.

5. A cutting element according to claim 1, wherein the cutting element is in the form of a tablet having generally parallel front and rear surfaces and a peripheral surface.

6. A cutting element according to claim 5, wherein the peripheral surface of the cutting element is circular or part circular.

7. A cutting element according to claim 1, wherein a portion of the body of polycrystalline diamond which is nearer to the body of polycrystalline diamond which is nearer to the body of composite material includes a greater proportion of binder-catalyst than a portion thereof which is further from the composite material.

8. A cutting element for a rotary drag-type drill bit comprising a body of polycrystalline diamond incorporating a binder-catalyst selected from iron group elements or alloys thereof, said body being brazed to a substrate by use of a brazing wherein the substrate comprises a body of diamond/tungsten carbide/binder-catalyst composite material and a body of cemented tungsten carbide brazed together by use of a brazing alloy.

9. A cutting element according to claim 8, wherein the cutting element has an outer surface which is coated with a material to allow the cutting element to be brazed to another material.

10. A cutting element according to claim 8, wherein the cutting element has an outer surface which is formed with a plurality of projections and recesses which, in use, interlock with a material within which the cutting element is embedded.

11. A cutting element according to claim 8, wherein the cutting element is in the form of a tablet having generally parallel front and rear surfaces and a peripheral surface.

12. A cutting element according to claim 11, wherein the peripheral surface of the cutting element is circular or part circular.

13. A cutting element according to claim 8, wherein a portion of the body of polycrystalline diamond which is nearer to the body of composite material includes a greater proportion of binder-catalyst than a portion thereof which is further from the composite material.

* * * * *